US007053757B2

(12) United States Patent
Buckingham et al.

(10) Patent No.: US 7,053,757 B2
(45) Date of Patent: May 30, 2006

(54) INTELLIGENT DOOR PLATE AND CHIME

(75) Inventors: Duane W. Buckingham, Old Lyme, CT (US); Richard N. Quirino, Discovery Bay, CA (US); David G. Oliver, Old Lyme, CT (US)

(73) Assignee: Inncom International, Inc., Old Lyme, CT (US)

( * ) Notice: Subject to any disclaimer, the term of this patent is extended or adjusted under 35 U.S.C. 154(b) by 89 days.

(21) Appl. No.: 10/029,057

(22) Filed: Dec. 20, 2001

(65) Prior Publication Data

US 2002/0149492 A1 Oct. 17, 2002

Related U.S. Application Data

(60) Provisional application No. 60/257,010, filed on Dec. 20, 2000.

(51) Int. Cl.
*G08B 3/00* (2006.01)

(52) U.S. Cl. ..... 340/328

(58) Field of Classification Search ..... 340/286.08, 340/332, 540, 541, 300, 330, 815.4, 815.47, 340/686.1, 328, 691.1, 691.6, 326; 235/380, 235/381, 382, 383

See application file for complete search history.

(56) References Cited

U.S. PATENT DOCUMENTS

| | | | | | |
|---|---|---|---|---|---|
| 4,523,193 | A | * | 6/1985 | Levinson et al. | 340/825.69 |
| 5,428,345 | A | * | 6/1995 | Bruno | 340/541 |
| 5,774,039 | A | * | 6/1998 | Housley | 340/326 |
| 5,861,806 | A | * | 1/1999 | Vories et al. | 340/555 |
| 6,107,928 | A | * | 8/2000 | Gatti | 340/681.1 |
| 6,236,303 | B1 | | 5/2001 | Wagner et al. | 340/286.08 |
| 6,359,564 | B1 | * | 3/2002 | Thacker | 340/573.1 |
| 6,414,589 | B1 | * | 7/2002 | Angott et al. | 340/326 |

* cited by examiner

*Primary Examiner*—Jeffery Hofsass
(74) *Attorney, Agent, or Firm*—Cantor Colburn LLP

(57) ABSTRACT

A system in operable communication with a doorbell chime for audio annunciation of a visitor to an occupant of a room in a multiple room building, the system configured to indicate a status of the room to the visitor or occupant, the system comprising: a switch assembly configured to convey a message outside of the room; the switch assembly operable from inside the room; an indicating assembly in operable communication with the switch assembly, the indicating assembly configured to indicate the message when the message is selected, the message viewable from inside and outside of the room; and a doorbell button in operable communication with the doorbell chime, the doorbell button operably connected with the indicating assembly and operable from outside of the room by the visitor.

73 Claims, 7 Drawing Sheets

INTELLIGENT DOOR PLATE AND CHIME

CROSS REFERENCE TO RELATED APPLICATIONS

This application is based upon, and claims priority to U.S. Provisional Application Ser. No. 60/257,010, filed Dec. 20, 2000.

BACKGROUND

In hotels, motels, inns, and the like, guest rooms typically have a means for indication of the occupant's desire that the housekeeping service make-up the room or leave the room undisturbed. Typically, this is accomplished by the use of a card that is placed on the handle of the door. One side of the card shows "do-not-disturb" and the other side shows "make-up-room." If the occupant wishes to be undisturbed, he or she places the card on the knob outside the door so that the "do-not-disturb" sign is visible. If the occupant wishes to have the housekeeping service make-up the room, the occupant places the card on the knob outside the door so that the "make-up-room" sign is visible.

One of the drawbacks to using the doorknob mounted card is that the cards are awkward and tend to fall off when the door is closed. In addition, a doorknob mounted card is susceptible to pranksters, who have been known to switch or remove the cards. Another drawback to the use of a doorknob mounted card is that it requires the occupant to open the door to place the card on the knob outside the door. This can be an inconvenience to the occupant.

To overcome these drawbacks, indicator lights have been used. Typically, indicator lights are mounted outside the guest room or at a remote housekeeping service station. The indicator lights are typically operated from within the guest room, making operation convenient for the occupant and preventing tampering by pranksters.

Many modern guest rooms include room control systems. Room control systems comprise a central control computer or device that receives data from various remote sensors and operates a number of remote room control devices. Such remote sensors include, for example, motion sensors, temperature sensors, smoke detectors, and door and other closure switches. Such remote room control devices include, for example, thermostats and associated relays for heating, ventilation and air conditioning (HVAC) equipment, electronic locks, lighting control switches and relays, and motors and switches for opening and closing drapes. The central control computer uses the data and control devices to, for example, adjust the room's temperature, determine and annunciate whether the room is occupied or unoccupied, determine and annunciate whether the room's mini-bar has been accessed, sound fire and emergency alarms, turn lights on or off, permit or deny access to the room, open and close drapes, turn audio-visual equipment on or off, and perform other functions related to controlling equipment or annunciating status in rooms. A central control computer or device may be located in each room, and all rooms can be tied to a single master central control computer. Where a central control computer or device is used in each room, each such computer or device can provide data to the master central control computer from which such data is disseminated to display and control terminals at housekeeping, front desk, security, engineering or any number of other locations in order to provide hotel personnel with access to the data and with the ability to remotely control various room functions or settings from such terminals.

Room control systems are valuable tools for the lodging industry. Unfortunately, the equipment and installation costs associated with room control systems are generally too expensive for most new construction and renovation projects.

BRIEF SUMMARY OF THE INVENTION

The above discussed and other drawbacks and deficiencies are overcome or alleviated by a system in operable communication with a doorbell chime for audio annunciation of a visitor to an occupant of a room in a multiple room building. The system is configured to indicate a status of the room to the visitor or occupant, the system comprising: a switch assembly configured to convey a message outside of the room; the switch assembly operable from inside the room; an indicating assembly in operable communication with the switch assembly, the indicating assembly configured to indicate the message when the message is selected, the message viewable from inside and outside of the room; and a doorbell button in operable communication with the doorbell chime, the doorbell button operably connected with the indicating assembly and operable from outside of the room by the visitor.

DETAILED DESCRIPTION OF THE INVENTION

Figure 1:
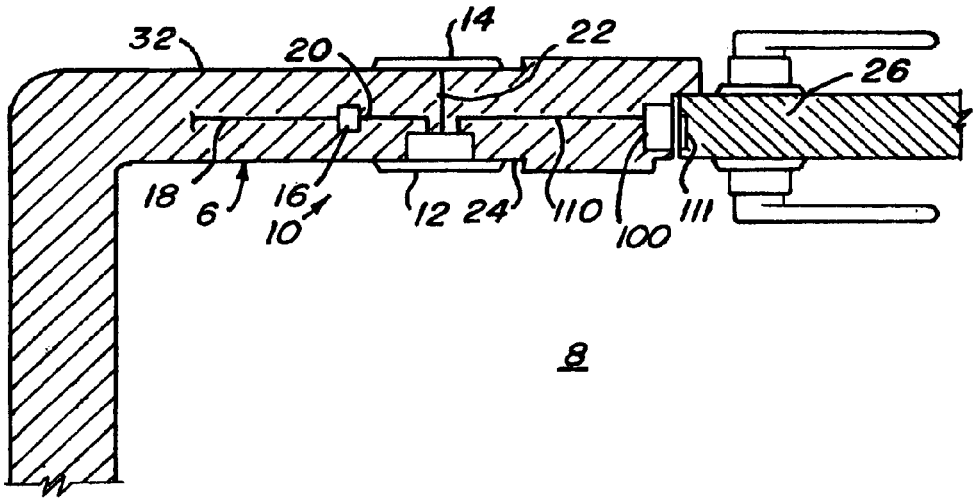
FIG. 1 is a top sectional view of a wall within a guest room showing the installation of an intelligent doorbell/do-not-disturb/make-up-room annunciation system.
Figure 2:
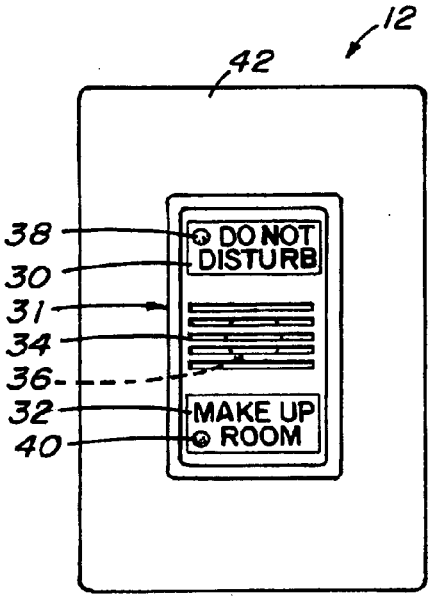
FIG. 2 is a front view of the intelligent internal door plate of FIG. 1 with a cover plate installed.
Figure 6:
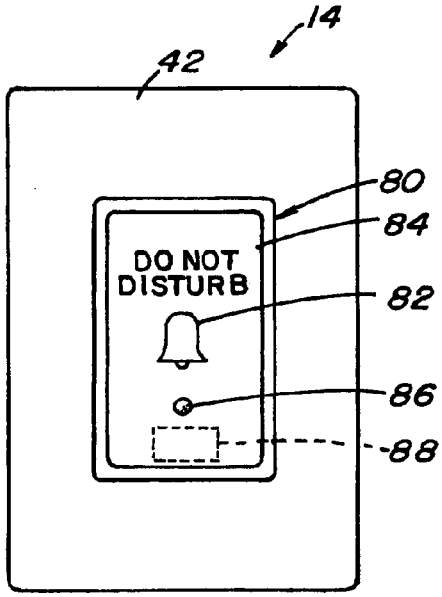
FIG. 6 is a front view of the external door plate of FIG. 1 with a cover plate installed.
Figure 5:
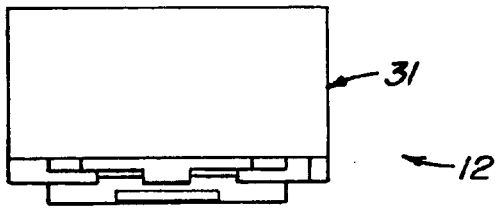
FIG. 5 is a top view of the intelligent internal door plate of FIG. 1 with the cover plate removed.

Referring to FIG. 1, a top sectional view of a wall 6 of a guest room 8 shows the installation of an intelligent doorbell/do-not-disturb/make-up-room annunciation system 10. System 10 includes a switch assembly or intelligent internal door plate 12, an indicating assembly or external door plate 14 with do-not-disturb/make-up-room annunciation, and a power supply device 16. Power supply device 16 is electrically connected to line voltage wiring 18, such as a 120 volt power supply. Power supply device 16 is electrically connected via wires 20 to internal door plate 12, which is, in turn, electrically connected via wires 22 to external door plate 14. Internal door plate 12 is mounted to a surface 24 of wall 6 within guest room 8, preferably near a door 26 to the guest room 8. External door plate 14 is mounted to a surface 32 of wall 6 external to the guest room 8, preferably near the door 26.

Power is supplied to the internal door plate 12 from power supply device 16, which may comprise any U/L (or other appropriately) approved device that can receive 100–240VAC (50–60 Hz) line voltage inputs and deliver, for example, 300 mA of 12VDC output. Power supply device 16 may be mounted in any location at which it can tap into line voltage wiring 18 and from which low voltage wires 20 can be run to the internal door plate 12.

An entry door switch 100 is optionally coupled to door plate 12 via line 110 for communicating an open or closed door condition to door plate 12. Entry door switch 100 is preferably located proximate door 26 on wall 6. A mechanical or magnet contact 111 may be disposed on door 26 to provide operable communication of door 26 in an open or closed condition to switch 100.

Referring to FIGS. 2 through 5, various views of the internal door plate 12 are shown. The internal door plate 12 has a "Do Not Disturb" (DND) button 30 and a "Make Up Room" (MUR button) 32 attached to a core housing 31. Each button 30 and 32 has a small LED 38, 40 (a LED 38 for DND; a LED 40 for MUR) that lights when that button function is active (e.g., when the button 30 or 32 is depressed). Centered vertically in core housing 31, between DND and MUR buttons 30 and 32, is a small grill 34, behind which is located a round chime speaker 36.

A standard, screwless, snap-on cover plate 42 is snap-fit to the core housing 31. Cover plate 42 may be manufactured from a selection of multiple colors and materials, including plastic and brass. The physical design of the core housing 31 is dimensioned to accommodate any Decora-type cover plate manufactured by many manufacturers (e.g., Leviton, Eagle or Lutron), and the internal door plate 12 can be mounted in a multiple gang box next to one or more Decora-style switches by using existing multiple-opening cover plates (not shown) produced by those same manufacturers.

In an alternative embodiment, a mounting plate (not shown) is positioned beneath the snap-on cover plate 42, and extends along the same plane as the snap-on cover plate 42. The mounting plate is secured to the core housing 31 using screws, bolts, or the like. The snap-on cover plate 42 is then snap-fit over the mounting plate.

Figure 3:
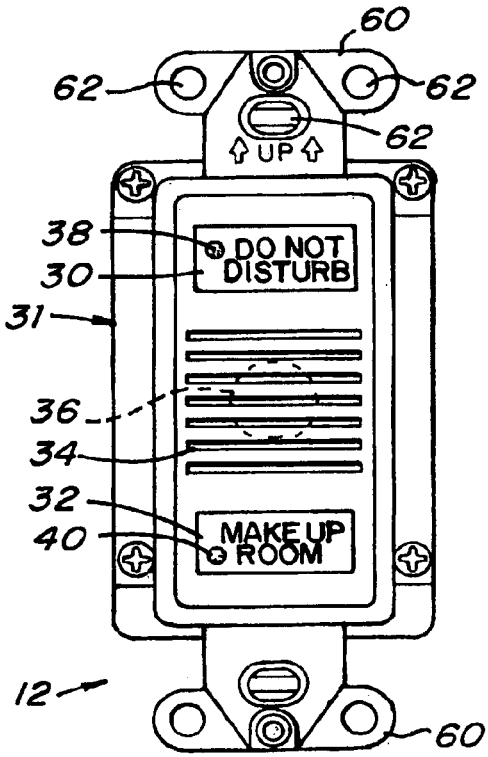
FIG. 3 is a front view of the intelligent internal door plate of FIG. 1 with the cover plate removed.
Figure 4:
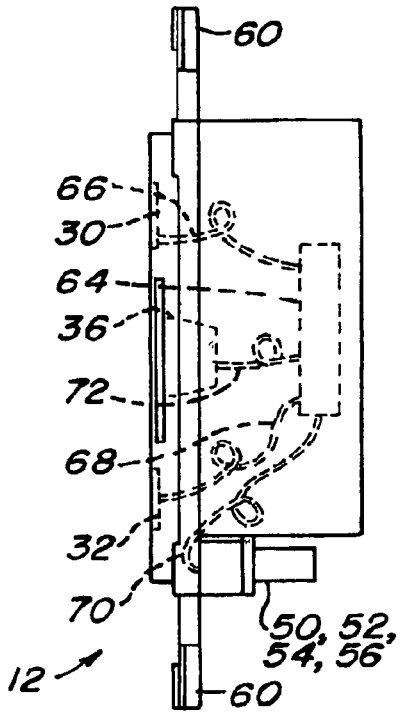
FIG. 4 is a side view of the intelligent internal door plate of FIG. 1 with the cover plate removed.
Figure 9:
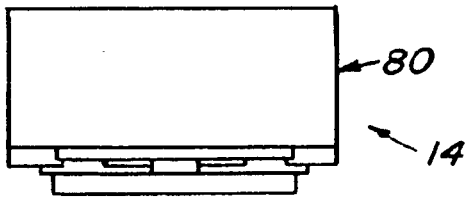
FIG. 9 is a top view of the external door plate of FIG. 1 with the cover plate removed.

As can best be seen in FIG. 3, internal door plate 12 includes tabs 60 extending from the top and bottom of core housing 31. Tabs 60 include apertures 62 disposed therethrough, which accept screws (not shown) for mounting internal door plate 12 to wall 6. Internal door plate 12 may be mounted to wall 6 in two ways. It can be secured with standard screws (not shown) to a standard, single gang junction box (not shown) mounted directly on a wall stud (not shown). Internal door plate 12 may also be mounted in a multi-gang junction box (not shown) together with entry light or other switches (not shown).

At the lower rear of the internal door plate 12 are four small connectors 50, 52, 54, and 56 for electrically connecting internal door plate 12 with external door plate 14 (FIG. 1), power supply device 16 (FIG. 1), and other optional devices (not shown).

Internal door plate 12 is an intelligent (smart) device. Internal door plate includes a circuit board 64 having a printed circuit and electronic components disposed thereon. The printed circuit is attached to DND button 30 by wires 66, to MUR button 32 by wires 68, to connectors 50, 52, 54, and 56 by wires 70 and to chime speaker 36 by wires 72. The functionality of circuit board will be described hereinafter, with reference to FIGS. 10 and 11.

Referring to FIGS. 6–9, a front view of the external door plate 14 is shown. External door plate 14 includes a core housing 80 with a doorbell button 82, a DND backlit legend 84, preferably backlit in red, a MUR single point light emitting diode (LED) 86, and a hidden switch 88, which may be either mechanically or magnetically queried.

A standard, screwless, snap-on cover plate 42 is snap-fit to the core housing 80. Cover plate 42 may be manufactured from a selection of multiple colors and materials, including plastic and brass. The physical design of the core housing 80 is dimensioned to accommodate any Decora-type cover plate manufactured by many manufacturers (e.g., Leviton, Eagle or Lutron), and the external door plate 14 can be mounted in a multiple gang box next to one or more Decora-style switches by using existing multiple-opening cover plates (not shown) produced by those same manufacturers.

In an alternative embodiment, a mounting plate (not shown) is positioned beneath the snap-on cover plate 42, and extends along the same plane as the snap-on cover plate 42. The mounting plate is secured to the core housing 80 using screws, bolts, or the like. The snap-on cover plate 42 is then snap-fit over the mounting plate.

At the rear of the external door plate 14 is a 6-pin Molex-type connector 90. Connector 90 accepts wires 22 (FIG. 1), which extend from internal door plate 12 to external door plate 14 for providing power the external door plate 14 and providing data flow between the two devices 12 and 14.

Figure 7:
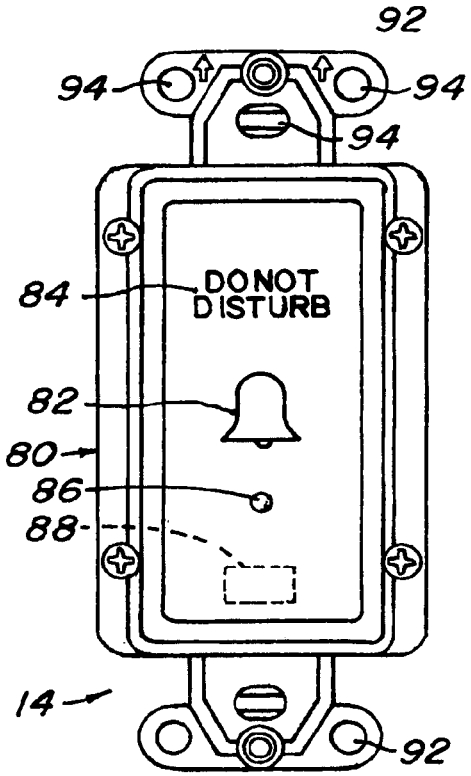
FIG. 7 is a front view of the external door plate of FIG. 1 with the cover plate removed.
Figure 8:
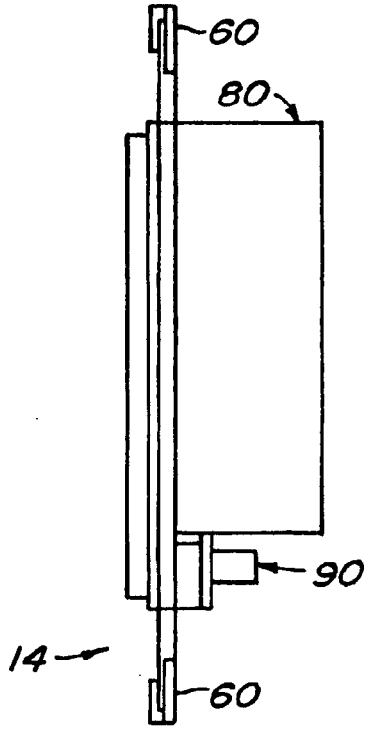
FIG. 8 is a side view of the external door plate of FIG. 1 with the cover plate removed.

As shown in FIG. 7, external door plate 14 includes tabs 92 extending from the top and bottom of core housing 80. Tabs 92 include apertures 94 disposed therethrough, which accept screws (not shown) for mounting external door plate 14 to wall 6. Like internal door plate 12, external door plate 14 may be mounted to wall 6 in two ways. It can be secured with standard screws (not shown) to a standard, single gang junction box (not shown) mounted directly on a wall stud (not shown). External door plate 14 may also be mounted in a multi-gang junction box (not shown) together with entry light or other switches (not shown).

In an alternative embodiment, not shown, the core housing 80 of external door plate 14 is dimensioned such that its thickness is reduced allowing the external door plate 14 to be mounted flush with external surface 32 of wall 6 (FIG. 1) using tabs 60, without having to penetrate surface 32 to accommodate the core housing 80. Only small penetrations would be necessary, to accommodate mounting screws (not shown) and wires 22 (FIG. 1). This embodiment would be beneficial if wall 6 (FIG. 1) were constructed of a hard material such as concrete.

Figure 10:
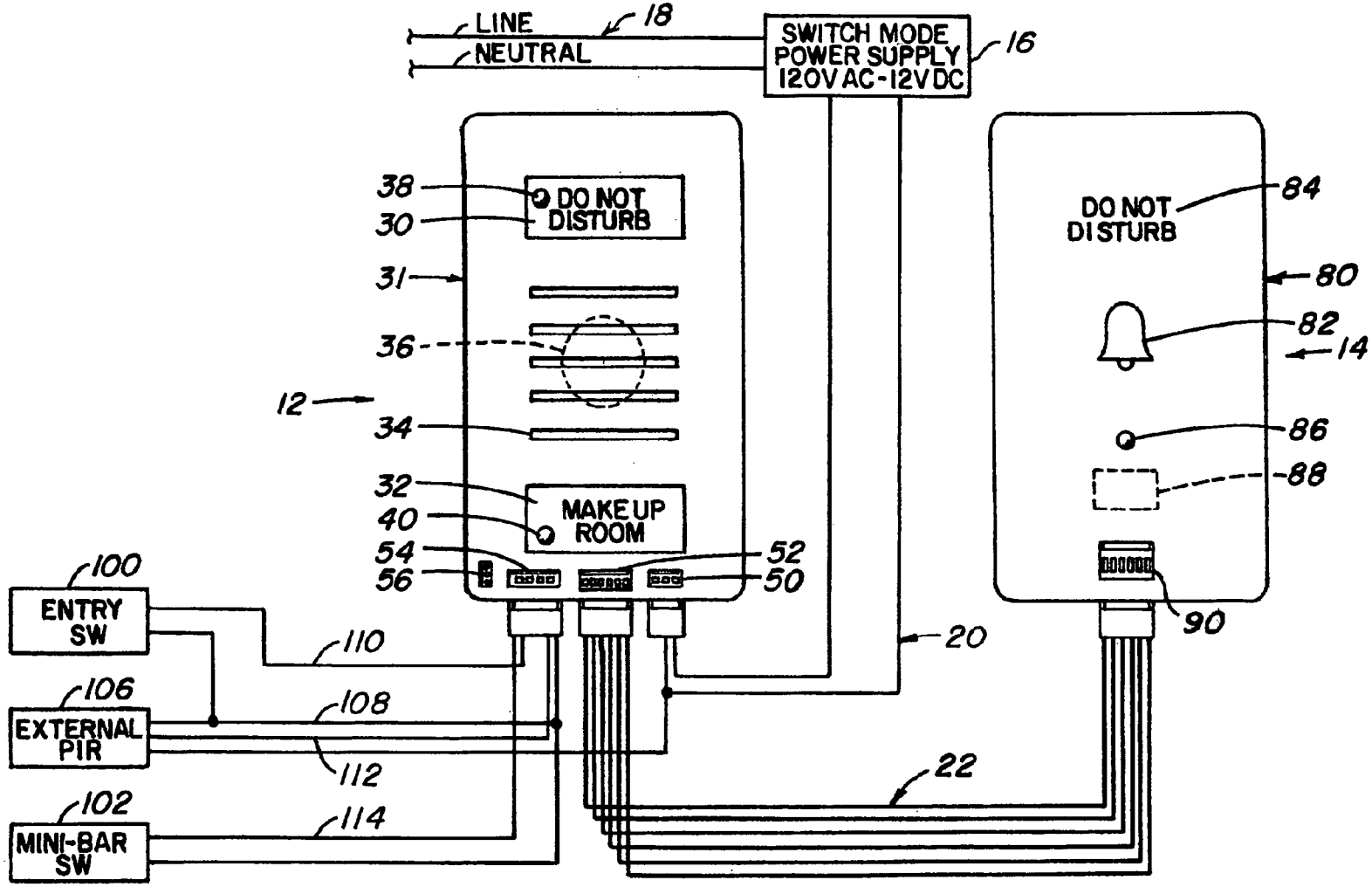
FIG. 10 is a multi-line wiring diagram depicting the intelligent doorbell/do-not-disturb/make-up-room annunciation system of FIG. 1 with door entry, mini-bar door, and passive infra-red sensors.

In FIG. 10, intelligent doorbell/do-not-disturb/make-up-room annunciation system 10 is shown connected to optional entry door sensor or switch 100, mini-bar sensor 102, and passive infra-red sensor 106. Connector 50 is a 3-pin connector that accepts the 2-wire power supply 20 from the power supply device 16. Connector 50 is also configured to accept a 3-wire power supply, which is commonly used in centralized, room control systems (shown in FIGS. 12 and 13). Wires 22 comprise six wires that each attach at one end to 6-pin connector 52 and at an opposite end to 6-pin connector 90. Wires 22 provide data and power flow between the internal and external door plates 12 and 14. Connector 54 is a 4-pin connector that provides for a common wire 108 and 3 input wires 110, 112, and 114. Wires 110, 112, and 114 provide data input to internal door plate 12 from optional entry door switch 100, passive infra-red sensor 106, and mini-bar switch 102, respectively. Connector 56 is a 3-pin connector with a 2-pin jumper, which is used for adjusting the occupancy sensing capability of internal door plate 12.

Figure 11:
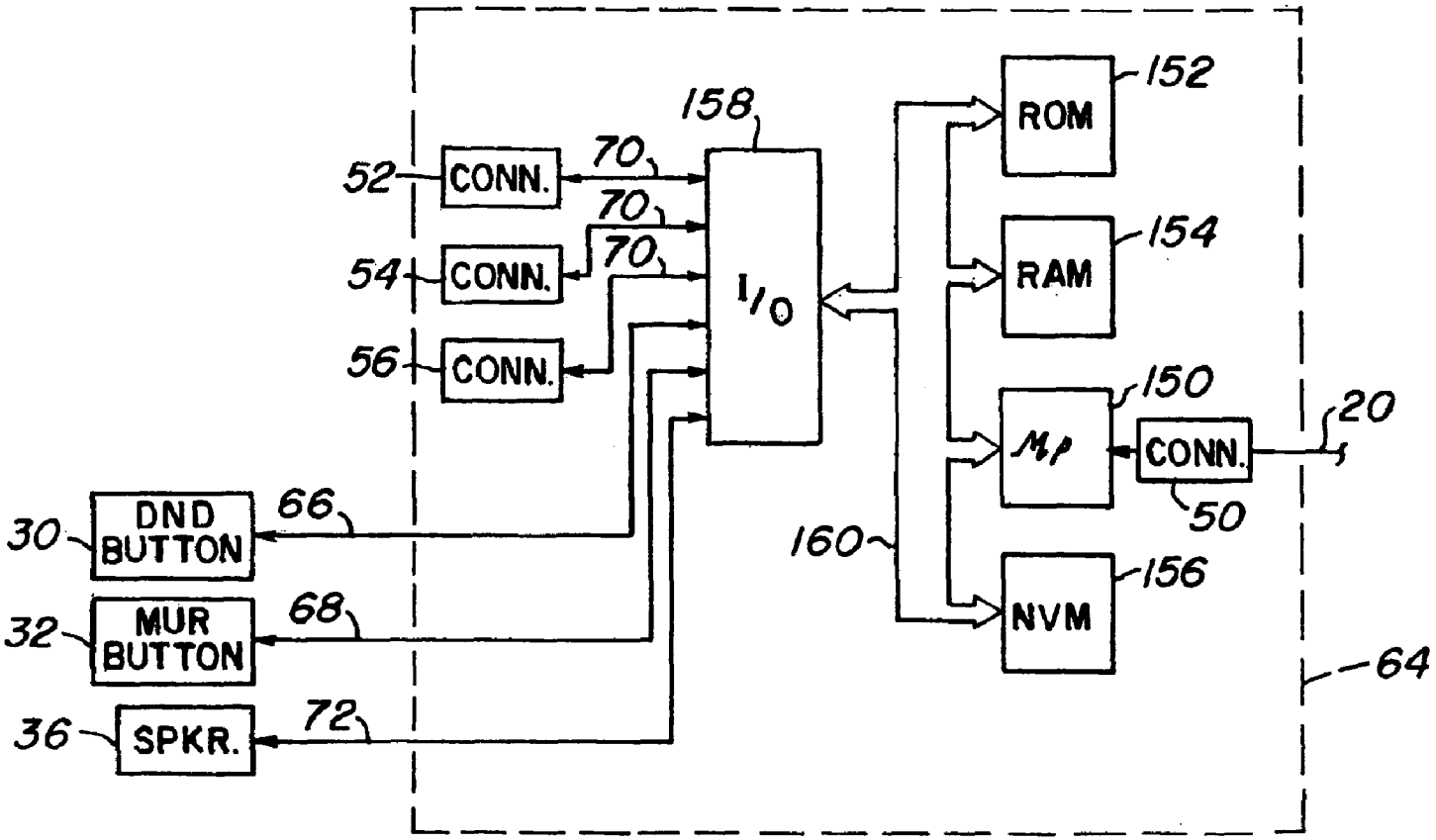
FIG. 11 is a schematic diagram of the printed circuit and electronic components on a circuit board within the intelligent internal door plate of FIG. 1.

FIG. 11 is a schematic diagram of the printed circuit and electronic components on circuit board 64. Mounted on circuit board 64 are a microprocessor 150, ROM (read only memory) 152, RAM (random access memory) 154, NVM (non-volatile memory) 156, I/O control device 158, and a data bus 160. Data bus 160 interconnects microprocessor 150, ROM 152, RAM 154, NVM 156, and I/O control device 158, allowing data to be transferred between these devices. I/O control device 158 sends/receives analog input data to/from: DND button 30 via wires 66, MUR button 32 via wires 68, and connectors 52, 54, and 56 via wires 70. I/O control device 158 also provides an actuation signal to chime speaker via wires 72. Microprocessor 150 receives operating power via power supply 20 at connector 50.

ROM 152 stores boot-code for directing microprocessor 150 when microprocessor 150 is initially powered-up. NVM 156 stores programming instructions that are transferred into RAM 154 by microprocessor 150 and then executed by microprocessor 150. The functionality provided by the execution of the programming instructions by microprocessor 150 can now be described with reference to FIGS. 10 and 11.

Referring to FIGS. 10 and 11, internal door plate 12 permits the guest of room 8 (FIG. 1) to activate or deactivate DND and MUR requests without needing to open the door 26 (FIG. 1). The guest simply depresses either the MUR button 32 or the DND button 30. When the DND button 30 is depressed, internal door plate 12 provides a power to the DND legend 84, and the backlit DND legend 84 appears above the doorbell button 82. In addition, the doorbell button 82 is deactivated. When the MUR button 32 is depressed, the internal door plate 12 illuminates the green LED 86. The functionality of the DND and MUR buttons 30 and 32 is mutually exclusive, so only one button 30 or 32 can be active at a time. If the DND button 30 is active and MUR button 32 is pressed, the DND button 30 will deactivate and the MUR button 32 will become active, and vice versa.

When either the DND or MUR button 30 or 32 is pressed, the LED 38 or 40 on that button is illuminated, so the guest knows which function has been activated. When the DND command is activated by the guest, the door chime 36 is muted. Additionally, when microprocessor 150 senses that the internal door plate 12 is connected to a centralized room control system, incoming calls to the room 8 can be diverted to voice mail and active MUR or butler call requests are cancelled when the DND command is activated. It will also be understood, that it is contemplated that, microprocessor 150 is optionally configured to serially connect with an incoming telephone line entering the room and configured to generate a signal when the DND command is activated in a stand alone set up to direct all incoming telephone calls to voicemail. The signal may duplicate a busy signal that causes many existing telephone systems to direct the incoming call to voicemail.

The chime speaker 36 of internal door plate 12 is sounded when the doorbell button 82 on external door plate 14 is pressed. When the doorbell button 82 is pressed, a signal is received by the internal door plate 12, and a single synthesized "ding dong" is sounded over its speaker 36. Each time a doorbell signal is received, the "ding dong" is sounded. (There is no time out between signals, so that, if the doorbell button 82 is pressed three times consecutively, the "ding dong" will sound three consecutive times.)

Entry switch 100 senses the opening and closing of door 26 (FIG. 1). Passive infra-red sensor 106 is positioned within room 8 (FIG. 1) to sense motion within room 8. Passive infra-red sensor 106 is optionally used to accept input from active infra-red devices within room 8, such as from a centrally controlled system discussed hereinafter. It is also contemplated that infra-red sensor 106 includes a transmitter for transmission of data from internal door plate 12 to centrally controlled system. Mini-bar switch 102 senses the opening and closing of a mini-bar (not shown) within room 8, or in some way senses depletion of mini-bar stock. A mini-bar is a convenient store of goods within each room, usually within a refrigerator, that can be accessed by the occupant at his or her discretion. Typically, the mini-bar is re-stocked after the occupant checks out, and the occupant is billed for the items that he or she consumed.

For occupancy sensing and annunciation, an entry door switch 100 (such as INNCOM's S241) and a 2-wire or 3-wire passive infra-red device 106 can be connected to internal door plate 12 via connector 54. Microprocessor 150 detects when a passive infra-red device 106 is connected at connector 54, and, in response, executes programming instructions for occupancy determination. Occupancy determination includes logic in the circuitry of internal door plate 12 in which the time-out between entry switch 100 activation and non-sensing by the passive infra-red sensor 106 can be programmed for 0, 10 or 30 minutes by adjusting the 2-pin jumper position on the 3-pin connector 56. If the room 8 is electronically determined to be occupied and the hidden (mechanical or magnetic) switch 88 is closed once, the backlit DND legend 84 will flash 3 or more times. If the room 8 is determined to be unoccupied, and the hidden switch 88 is closed, the green MUR LED 86 will flash 3 or more times.

For occupancy determination, the housekeeper or other staff member activates the hidden switch 88. Where hidden switch 88 is mechanically activated, a housekeeper or other staff member activates the hidden switch 88 by depressing it. Where hidden switch 88 is magnetically activated, the housekeeper or other staff member activates the hidden switch 88 by placing a small, handheld magnet (not shown) near the hidden switch. If the room 8 is occupied, the DND legend 84 flashes; if the room 8 is unoccupied, the green MUR LED 86 flashes.

The microprocessor 150 senses when a mini-bar switch is attached to connector 54, and, in response, executes programming instructions to sense a mini-bar door opening. Such opening can be queried by using the hidden mechanical or magnetic switch 88 on the external door plate 14. If the mini-bar door has been opened and the hidden switch 88 is closed twice in rapid succession, the backlit DND legend 84 will flash 3 or more times. If the mini-bar door has not been opened, the green MUR LED 86 will flash 3 or more times. In this embodiment, a normally closed switch, such as INNCOM's S241, is used as the mini-bar switch 102. The microprocessor 150 will reset the status to "not opened" in accordance with a "sequential openings/closings" routine. With the sequential openings/closings routine, if the microprocessor 150 senses a number (e.g. three) rapid openings/closings of the mini-bar door, the microprocessor 150 will reset the status to "not opened", allowing the housekeeping staff to reset the status of the mini-bar after stocking the mini-bar.

Figure 12:
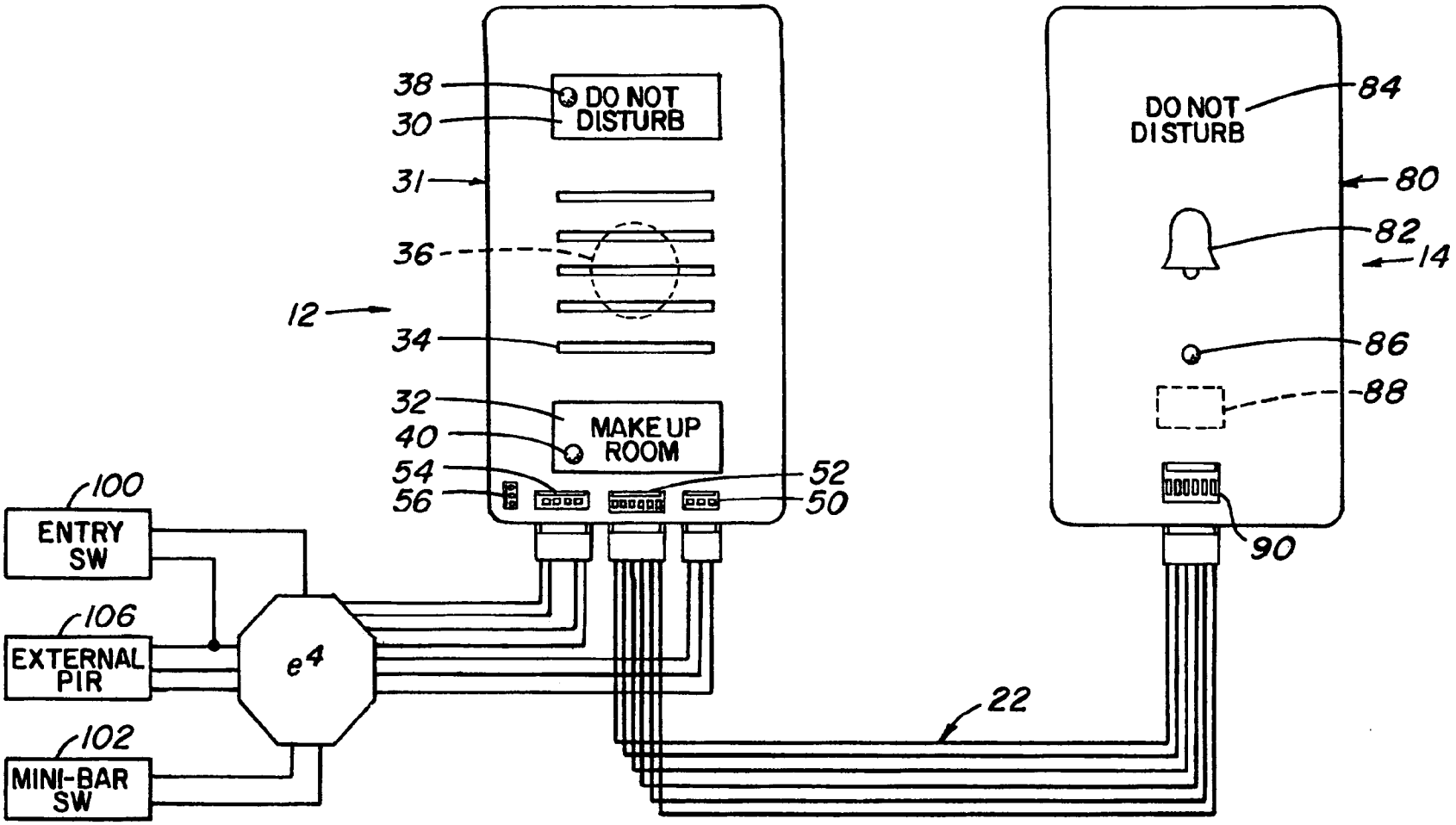
FIG. 12 is a multi-line wiring diagram of FIG. 10 incorporating a centrally controlled system intermediate the sensors and the intelligent doorbell/do-not-disturb/make-up-room annunciation system.
Figure 13:
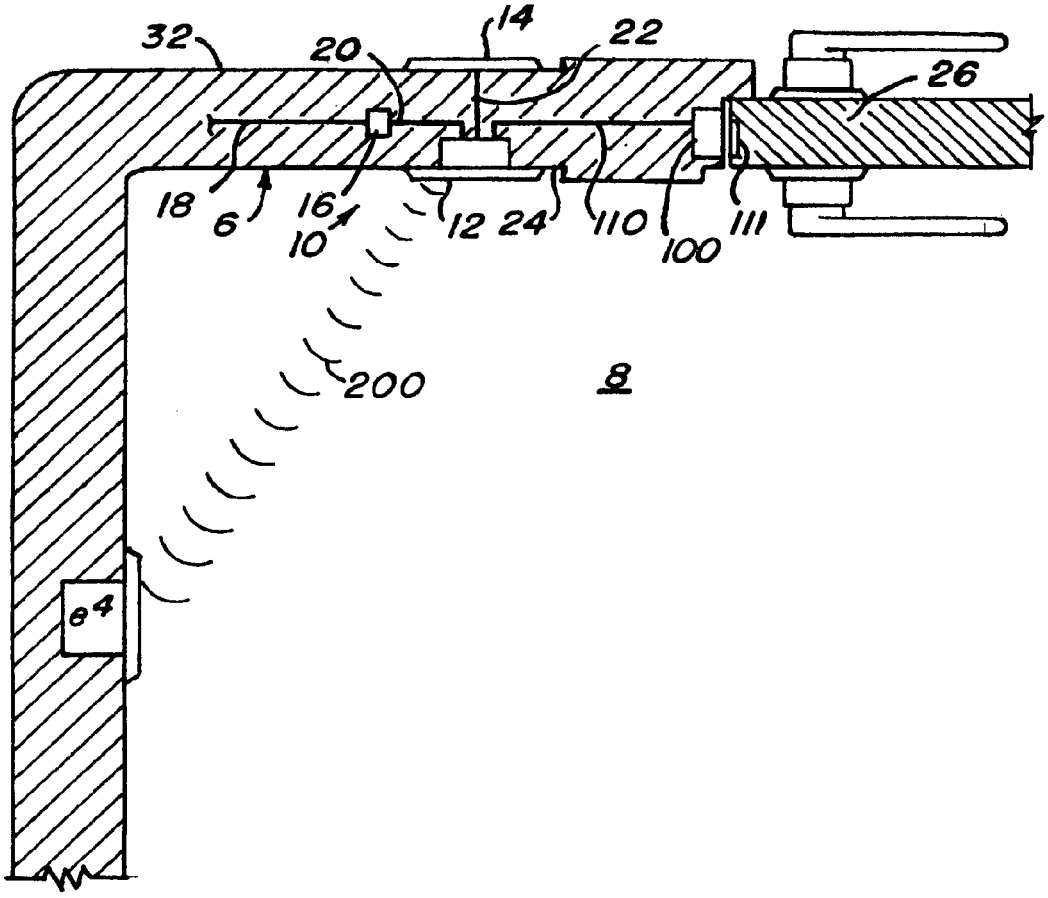
FIG. 13 is the top sectional view of the intelligent doorbell/do-not-disturb/make-up-room annunciation system in FIG. 1 in electromagnetic communication with a centrally controlled system.

Referring to FIGS. 10 and 12, microprocessor 150 recognizes that when the 2-wire power supply 20 from the power supply device 16 is connected to connector 50, system 10 is a stand-alone system (FIG. 10). That is, system 10 is not connected to a centrally controlled system. In this case, microprocessor executes programming instructions to processes data from entry switch 100 (optional), passive infra-red sensor 106 (optional), mini-bar switch 102 (optional), and external door plate 14, and provides control to these devices. However, when microprocessor 150 detects that a 3-wire connection is provided to connector 50, the microprocessor 150 executes programming instructions required for system 10 to act as part of a centrally controlled system, such as INNCOM's commercially available System 4 ($e^4$), shown in FIG. 12. When in a centrally controlled system, microprocessor 150 becomes subservient to a central control microprocessor in the centrally controlled system, accepting input from the central control microprocessor and providing data to the central control microprocessor via connection 54. FIG. 13 illustrates that transmission of data between microprocessor 150 and a central control processor of $e^4$ is optionally accomplished via electromagnetic radiation 200 using an infra-red communication device (not shown) with each microprocessor of the centrally controlled system and the internal door plate 12. In a centrally controlled system, both DND and MUR requests (initiated by depressing either the DND or MUR buttons 30 and 32) can be reported automatically to a floor status and/or a central control monitor for use by housekeeping and other staff.

The intelligent doorbell/do-not-disturb/make-up-room annunciation system 10 of the present disclosure is convenient, inexpensive, and expandable. System 10 overcomes the inconvenience of doorknob mounted tags by providing MUR and DND buttons within the guest room. System 10 is expandable to include other options such as a mini-bar switch, an entry switch, and a passive infra-red sensor, all of which provide convenience to housekeeping and other hotel staff. In addition, system 10 is a potential "starter kit" for an expanded system. Basic functionality can be expanded to include mini-bar and occupancy monitoring and annunciation by simply plugging devices into connections on the internal door plate 12. System 10 can also become part of a larger system, either standalone or centrally controlled without the need to make any hardware or software changes. Because system 10 can be expanded, the system will not have to be discarded with future expandability, creating a cost savings. Also, the internal and external door plates 12 and 14 of system 10 are sized to fit within the recess for a standard light switch, allowing door plates 12 and 14 to each be installed in a standard, single gang junction box or to be mounted in a standard multi-gang junction box together with entry light or other switches. Because the internal and external door plates can be installed in standard junction boxes, the cost of installation is reduced from that of previously available room control systems, which require customized installation.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A system for indicating a status of a minibar in a room, in a multiple room building, comprising:

an interface assembly configured to convey a minibar access condition to outside of the room;

a minibar door switch configured to detect an open minibar door indicative of said minibar access condition, said minibar door switch in operable communication with said interface assembly;

an indicator in operable communication with said interface assembly, said indicator configured for indicating, in response to a request, said minibar access condition, said indicator further configured for indicating outside of the room; and a first switch configured to be actuated from outside of the room for generating said request.

2. The system as claimed in claim 1 wherein said first switch comprises a discreet switch.

3. The system as claimed in claim 1 wherein said indicator is mounted to an interior wall of the room.

4. The system as claimed in claim 1 further comprises:

a second switch in operable communication with said interface assembly and configured to be actuated from inside the room for selecting at least one message; and wherein said indicator is configured to indicate said at least one message when said at least one message is selected.

5. The system as claimed in claim 1 wherein said indicator and said first switch are mounted to an exterior wall adjacent a doorway of the room.

6. The system as claimed in claim 4 wherein said at least one message includes a first message that an occupant does not wish to be disturbed and a second message that the occupant wishes to have the room cleaned or made up.

7. The system as claimed in claim 6 wherein said at least one message further includes a third message that the room is available for occupancy.

8. The system as claimed in claim 4 wherein said second switch includes a textual or symbolic representation of said at least one message associated therewith.

9. The system as claimed in claim 4 wherein said indicator comprises a light.

10. The system as claimed in claim 9 wherein said indicator further comprises a textual or symbolic representation of said at least one message associated therewith.

11. The system as claimed in claim 1 wherein said system is powered by one of wiring into the electrical system of the building and wiring to a centrally controlled system.

12. The system as claimed in claim 1 wherein the multiple room building comprises a hotel or motel and an occupant is a hotel or motel guest.

13. The system as claimed in claim 1 wherein said indicator is receptive to activation remotely.

14. The system as claimed in claim 1 further comprising a microprocessor in operable communication with said interface assembly.

15. The system as claimed in claim 1 wherein said first switch comprises a magnetic switch, said magnetic switch actuated with a magnet.

16. The system as claimed in claim 14 wherein said microprocessor is associated with said interface assembly.

17. The system as claimed in claim 14 wherein said microprocessor is disposed in a centrally controlled system disposed in the room, said centrally controlled system is in communication with said interface assembly.

18. The system as claimed in claim 17 further comprising:

an infra-red communication device associated with each of said interface assembly and said centrally controlled system for communication of signals therebetween.

19. The system as claimed in claim 1 wherein said minibar access condition is also conveyed to a location remote from said interface assembly and remote from said indicator.

20. A system for indicating an occupancy condition of a room, in a multiple room building, comprising:

an interface assembly configured to convey the occupancy condition of the room to outside of the room;

an entry door switch for detecting state of an entry door of the room, said entry door switch in operable communication with said interface assembly;

a passive infra-red device for detecting motion in the room, said passive infra-red device in operable communication with said interface assembly; and an indicator in operable communication with said interface assembly, said indicator configured for indicating, outside of the room, said occupancy condition when both said entry door switch detects a closed state of the entry door and said passive infra-red device detects motion within a delay.

21. The system as claimed in claim 20 wherein said indicator comprises a discreet indicator.

22. The system as claimed in claim 20 wherein said indicator is mounted to an interior wall of the room.

23. The system as claimed in claim 20 further comprises:

a switch configured to be actuated from inside of the room for selecting a at least one message; and wherein said indicator is configured to indicate said at least one message when said at least one message is selected.

24. The system as claimed in claim 20 wherein said indicator is mounted to an exterior wall adjacent a doorway of the room.

25. The system as claimed in claim 23 wherein said at least one message includes a first message that an occupant does not wish to be disturbed and a second message that the occupant wishes to have the room cleaned or made up.

26. The system as claimed in claim 25 wherein said at least one message further included a third message that the room is available for occupancy.

27. The system as claimed in claim 23 wherein said switch includes a textual or symbolic representation of said at least one message associated therewith.

28. The system as claimed in claim 23 wherein said indicator comprises a light.

29. The system as claimed in claim 28 wherein said indicator further comprises a textual or symbolic representation of said at least one message associated therewith.

30. The system as claimed in claim 20 wherein said system is powered by one of wiring into the electrical system of the building and wiring to a centrally controlled system.

31. The system as claimed in claim 20 wherein the multiple room building comprises a hotel or motel and an occupant is a hotel or motel guest.

32. The system as claimed in claim 20 wherein said indicator is receptive to actuation remotely.

33. The system as claimed in claim 20 further comprising a microprocessor in operable communication with said interface assembly.

34. The system as claimed in claim 33 wherein said interface assembly includes a jumper for selecting said delay from a plurality of preset delays.

35. The system as claimed in claim 33 wherein said switch comprises a magnetic switch, said magnetic switch actuated with a magnet.

36. The system as claimed in claim 31 wherein said microprocessor is disposed in said interface assembly.

37. The system as claimed in claim 31 wherein said microprocessor is disposed in a centrally controlled system disposed in the room, said centrally controlled system is in communication with said interface assembly.

38. The system as claimed in claim 37 further comprising:

an infra-red communication device associated with each of said interface assembly and said centrally controlled system for communication of signals therebetween.

39. The system as claimed in claim 20 wherein said occupancy condition is also conveyed to a location remote from said interface assembly and remote from said indicator.

40. The system as claimed in claim 20 wherein:

said indicator further comprises indicating said occupancy condition in response to a request; and said system further comprises a switch configured to be actuated from outside of the room for generating said request.

41. A system for indicating a status of a room, in a multiple room building, comprising:

a first switch configured to be actuated from inside the room for selecting at least one message;

an indicator in operable communication with said first switch, said indicator configured for indicating, in response to a request, at least one of (1) said at least one message when said at least one message is selected and (2) at least one condition of the room, said indicator further configured for indicating outside of the room; and a second switch configured to be actuated from outside of the room for generating said request.

42. The system as claimed in claim 41 wherein said second switch comprises discreet switch.

43. The system as claimed in claim 41 wherein said first switch is mounted to an interior wall of the room.

44. The system as claimed in claim 41 wherein said indicator is mounted to an exterior wall adjacent a doorway of the room.

45. The system as claimed in claim 41 wherein said at least one message includes a first message that an occupant does not wish to be disturbed and a second message that the occupant wishes to have the room cleaned or made up.

46. The system as claimed in claim 45 wherein said at least one message further includes a third message that the room is available for occupancy.

47. The system as claimed in claim 41 wherein said first switch includes a textual or symbolic representation of said at least one message associated therewith.

48. The system as claimed in claim 41 wherein said indicator comprises a light.

49. The system as claimed in claim 48 wherein said indicator further comprises a textual or symbolic representation of said at least one message associated therewith.

50. The system as claimed in claim 41 wherein said system is powered by one of wiring into the electrical system of the building and wiring to a centrally controlled system.

51. The system as claimed in claim 41 wherein the multiple room building comprises a hotel or motel and an occupant is a hotel or motel guest.

52. The system as claimed in claim 41 wherein said indicator is receptive to actuation remotely.

53. The system as claimed in claim 41 further comprising a microprocessor in operable communication with said first switch.

54. The system claimed in claim 41 further comprising:

an entry door switch and a passive infra-red devices for detecting a condition of occupancy, wherein said at least one condition of the room includes said condition of occupancy.

55. The system as claimed in claim 54 further comprising a jumper for selecting a preset period of delay from a plurality of preset periods of delay, said preset period of delay is used to determine said condition of occupancy.

56. The system as claimed in claim 41 wherein said at least one condition of the room comprises at least one of a condition of occupancy and a condition of minibar access.

57. The system as claimed in claim 53 wherein said microprocessor is associated proximally with said first switch.

58. The system as claimed in claim 53 wherein said microprocessor is disposed in a centrally controlled system disposed in the room, said centrally controlled system is in communication with said first switch.

59. The system as claimed in claim 58 further comprising:

an infra-red communication device associated with each of said first switch and said centrally controlled system for communication of signals therebetween.

60. The system as claimed in claim 41 wherein said at least one message selected by said first switch is communicated to a location remote from said first switch and remote from said indicator.

61. The system as claimed in claim 53 wherein said first switch is monitored and operated remotely.

62. The system as claimed in claim 41 further comprising:

a minibar door switch for detecting a condition of minibar access, wherein said at least one condition of the room includes said condition of minibar access.

63. The system as claimed in claim 41 wherein said first switch is incorporated with an electronic thermostat.

64. The system as claimed in claim 41, further comprising:

a doorbell chime for audio annunciation of a visitor to an occupant of the room, said doorbell chime disposed at said switch assembly; and a doorbell button in operable communication with said doorbell chime, said doorbell button operably connected with said indicator and operable from outside of the room by the visitor.

65. The system as claimed in claim 64 wherein said at least one message comprises a message that an occupant does not wish to be disturbed, said doorbell chime being configured to be muted when said message that an occupant does not wish to be disturbed is selected.

66. The system as claimed in claim 64 wherein said at least one message comprises a message that an occupant does not wish to be disturbed, wherein all incoming telephone calls to the room are routed to voicemail when said message that an occupant does not wish to be disturbed is selected.

67. The system as claimed in claim 56 wherein said second switch is actuated in one manner to indicate a condition of occupancy and activated in another manner to indicate said condition of minibar access, said at least one said condition of the room includes said condition of occupancy.

68. The system as claimed in claim 67 wherein said one manner includes pushing said second switch once, while said another manner includes pushing said second switch twice.

69. The system as claimed in claim 67 wherein said one manner to indicate said condition of occupancy comprises a first number of blinks, and said other manner to indicate said condition of minibar access includes a second number of blinks.

70. The system as claimed in claim 67 wherein each of said one manner to indicate said condition of occupancy and said other manner to indicate said condition of minibar access is indicated by a do not disturb legend flashing a number of times.

71. The system as claimed in claim 67 wherein each of said one manner to indicate said condition of minibar access and said other manner to indicate said condition of occupancy is indicated by a make-up-room LED flashing a number of times.

72. The system as claimed in claim 70 wherein said do not disturb legend flashes red.

73. The system as claimed in claim 71 wherein said make-up-room LED flashes green.

* * * * *